US008302812B2

(12) United States Patent
Reynolds

(10) Patent No.: US 8,302,812 B2
(45) Date of Patent: Nov. 6, 2012

(54) DISPENSER WITH DISCRETE DISPENSE CYCLES

(75) Inventor: Aaron R. Reynolds, North Canton, OH (US)

(73) Assignee: GOJO Industries, Inc., Akron, OH (US)

( * ) Notice: Subject to any disclaimer, the term of this patent is extended or adjusted under 35 U.S.C. 154(b) by 810 days.

(21) Appl. No.: 12/488,111

(22) Filed: Jun. 19, 2009

(65) Prior Publication Data

US 2010/0320227 A1 Dec. 23, 2010

(51) Int. Cl.
*B67D 1/00* (2006.01)

(52) U.S. Cl. ..... 222/63; 222/18; 222/181.3; 222/207; 222/214; 222/190; 222/383.1; 222/642; 222/309; 222/333; 222/325; 417/44.1; 417/411

(58) Field of Classification Search ..... 222/14–22, 222/52, 63, 181.3, 190, 207, 214, 309, 325, 222/333, 372, 383.1, 450–451, 642; 141/360; 417/20, 43, 44.1, 53, 411
See application file for complete search history.

(56) References Cited

U.S. PATENT DOCUMENTS

| | | | | |
|---|---|---|---|---|
| 4,509,903 | A | 4/1985 | Fraum | |
| 4,921,150 | A * | 5/1990 | Lagergren et al. | 222/639 |
| 5,295,807 | A * | 3/1994 | Wiley et al. | 417/274 |
| 5,305,915 | A | 4/1994 | Kaymsz et al. | |
| 5,605,251 | A | 2/1997 | Retti | |
| 5,730,819 | A | 3/1998 | Retti | |
| 6,012,903 | A | 1/2000 | Boelkins | |
| 6,161,733 | A * | 12/2000 | King | 222/380 |
| 6,641,002 | B2 * | 11/2003 | Gerenraich et al. | 222/333 |
| 2005/0211729 | A1 | 9/2005 | Bassett et al. | |

* cited by examiner

*Primary Examiner* — Kevin P Shaver
*Assistant Examiner* — Andrew P Bainbridge
(74) *Attorney, Agent, or Firm* — Calfee, Halter & Griswold LLP

(57) ABSTRACT

A dispenser includes a pump that, upon actuation, progresses through a discrete dispense cycle to dispense a discrete dose of product. The dispenser further includes an actuating mechanism serving to actuate the pump, and a dispenser controller that controls operation of the actuation mechanism. The discrete dose is less than a desired dose. When the dispenser controller receives a single dispense request, the dispenser controller causes the actuating mechanism to actuate the pump through multiple discrete dispense cycles so as to dispense multiple discrete doses to achieve a dispensing of the desired dose.

16 Claims, 3 Drawing Sheets

DISPENSER WITH DISCRETE DISPENSE CYCLES

FIELD OF THE INVENTION

The present invention generally relates to dispensers for dispensing liquid or foam product. In particular embodiments, the present invention relates to a dispenser including a pump that dispenses a discrete dose of product upon actuation, the pump being actuated multiple times to dispense a desired dose.

BACKGROUND OF THE INVENTION

Product dispensers of the type under consideration in this application are well known. With reference to FIG. 1, a particular wall-mounted type dispenser is shown and designated by the numeral 10. The dispenser 10 includes a housing 12 comprised of a back plate 13 and a cover 14. The back plate 13 is typically mounted to a wall, and the cover 14 is pivotally secured thereto, as at hinge 16, so that it can pivot relative to the back plate 13 from a closed position, as shown in FIG. 1, to an open position (not shown, but well known) so that the dispenser housing 12 can accept a refill unit of product.

As seen in FIG. 2, the refill unit 20 includes a product container 22 holding a volume of product P for dispensing. A pump 24 is secured to the container 22, and communicates with the interior thereof, such that, upon actuation of the pump 24, product P is advanced to the outlet 26 of the pump 24. As seen in FIG. 1, the outlet 26 is positioned so as to dispense to a user's hand. Actuation of the pump 24 may be initiated by a touchless sensor 28 sensing the presence of the hand below the outlet 26.

Some dispensers employ pumps that advance and dispense continuously, with the volume thus dispensed being dictated by the amount of time that the pump is actuated. These pumps can be considered to have variable dispense cycles in that the dose of product they provide varies with the duration of the continuous actuation of the pump. Gear pumps and impeller pumps are good examples of such pumps. Other dispensers employ pumps that have discrete dispense cycles, wherein only a unit dose of product is dispensed upon actuation of the pump. These pumps typically operate by trapping a fixed amount (i.e., discrete dose) of product and then displacing that fixed amount to a discharge area. Peristaltic pumps, dome pumps, and reciprocating piston pumps are good examples of pumps that dispense through such a discrete dispense cycle. Pumps having discrete dispense cycles are the focus of this invention.

A pump has a "discrete dispense cycle" when the pump has an actuated state and an unactuated state, with the pump dispensing a discrete dose of product upon manipulation from the unactuated state to the actuated state. At some point during the dispense cycle, the pump is recharged with another discrete dose of product. In certain pumps having discrete dispense cycles, the pump is recharged with another dose of product upon return from the actuated state to the unactuated state, and, in other pumps having discrete dispense cycles, the pump is recharged with another dose of product at the start of the actuation of the next dispense cycle. Broadly, a "discrete dispense cycle" is to be understood as the cycle through which the pump progresses to dispense a single discrete dose. Typically this will involve manipulating the pump from the unactuated state to the actuated state to dispense product, followed by the return of the pump from the actuated state to the unactuated state, but this invention is not necessarily limited to or by such pumps. The "discrete dose" of product is simply the volume of product dispensed upon one actuation of the pump, or upon one progression through the discrete dispense cycle.

In the dispensers of the prior art that employ pumps having discrete dispense cycles, the pumps are designed with the intention that a single actuation of the pump, i.e., manipulation through a single discrete dispense cycle, is to provide an adequate dose of product suitable for the end use of that product. For example, in the case of soap dispensers, one actuation of the pump is intended to provide an adequate dose of soap for washing one's hands. In the art of soap dispensing and in personal care product dispensing in general, this has been the practice for decades.

Because a single actuation of the pump is to provide a suitable dose of product, to the extent that different applications require different doses of product, the pump must be specifically designed for each application. For example, in an application where a 2 ml dose of product is desired, the pump will have to be designed so that it dispenses 2 ml of product upon a single actuation, and, in an application where a 1 ml dose is desired, the pump will have to be designed so that it dispenses 1 ml of product upon a single actuation.

For those business entities that design, manufacture and/or supply dispensers employing pumps having discrete dispense cycles, it is inefficient to have to design, manufacture and supply different pumps for different applications requiring different doses of product. Additionally, when operating a dispenser having a pump with a discrete dispense cycle, the only way to dispense a dose of product different from the discrete dose is to require the user to actuate the pump multiple times or to "short stroke" the pump or perform some combination of full actuation and short stroking. Pumps with discrete dispense cycles are "short stroked" when the pump is not fully actuated and therefore only dispenses a portion of the intended discrete dose. Short stroking often has negative effects on subsequent actuations of the pump.

It should also be appreciated that it takes a certain amount of power to manipulate a pump through a discrete dispense cycle. For battery powered dispensers employing pumps with discrete dispense cycles, the dispenser will cease to operate once the power supplied by the battery is lower than the power needed to manipulate the pump to the actuated state.

It should also be appreciated that the physical size of the pump varies depending on the dose it is designed to dispense. In general, the size of the discrete dispense cycle pump is proportional to the size of the dose it dispenses, such that the larger dose a discrete dispense cycle pump is designed to dispense, the larger the physical size of the pump. For example, a pump designed to dispense 2 ml in a single dose is typically (if not axiomatically) larger than a pump designed to dispense a 1 ml dose of product.

In light of the forgoing, dispensers employing pumps with discrete dispense cycles could be improved by designing the dispensers such that they can be made to dispense differing desired doses of product without requiring different pumps. The art could be further improved by providing battery-powered dispensers that more efficiently utilize the power in the batteries.

SUMMARY OF THE INVENTION

In one embodiment, the present invention provides a dispenser including a pump that, upon actuation, progresses through a discrete dispense cycle to dispense a discrete dose of product. The dispenser further includes an actuating mechanism serving to actuate the pump, and a dispenser controller that controls operation of the actuation mechanism.

The discrete dose dispensed in a single dispense cycle by the pump disclosed herein is less than a desired dose. When the dispenser controller receives a single dispense request, the dispenser controller causes the actuating mechanism to actuate the pump through multiple discrete dispense cycles so as to dispense multiple discrete doses to achieve a dispensing of the desired dose.

Ideally, the multiple discrete dispense cycles will be dispensed from the pump in a relatively short amount of time, so that the user does not inadvertently remove their hand from below the dispenser believing that the dispense cycle has been complete before the appropriate number of dispense cycles has been completed.

DETAILED DESCRIPTION OF ILLUSTRATIVE EMBODIMENTS

Figure 1:
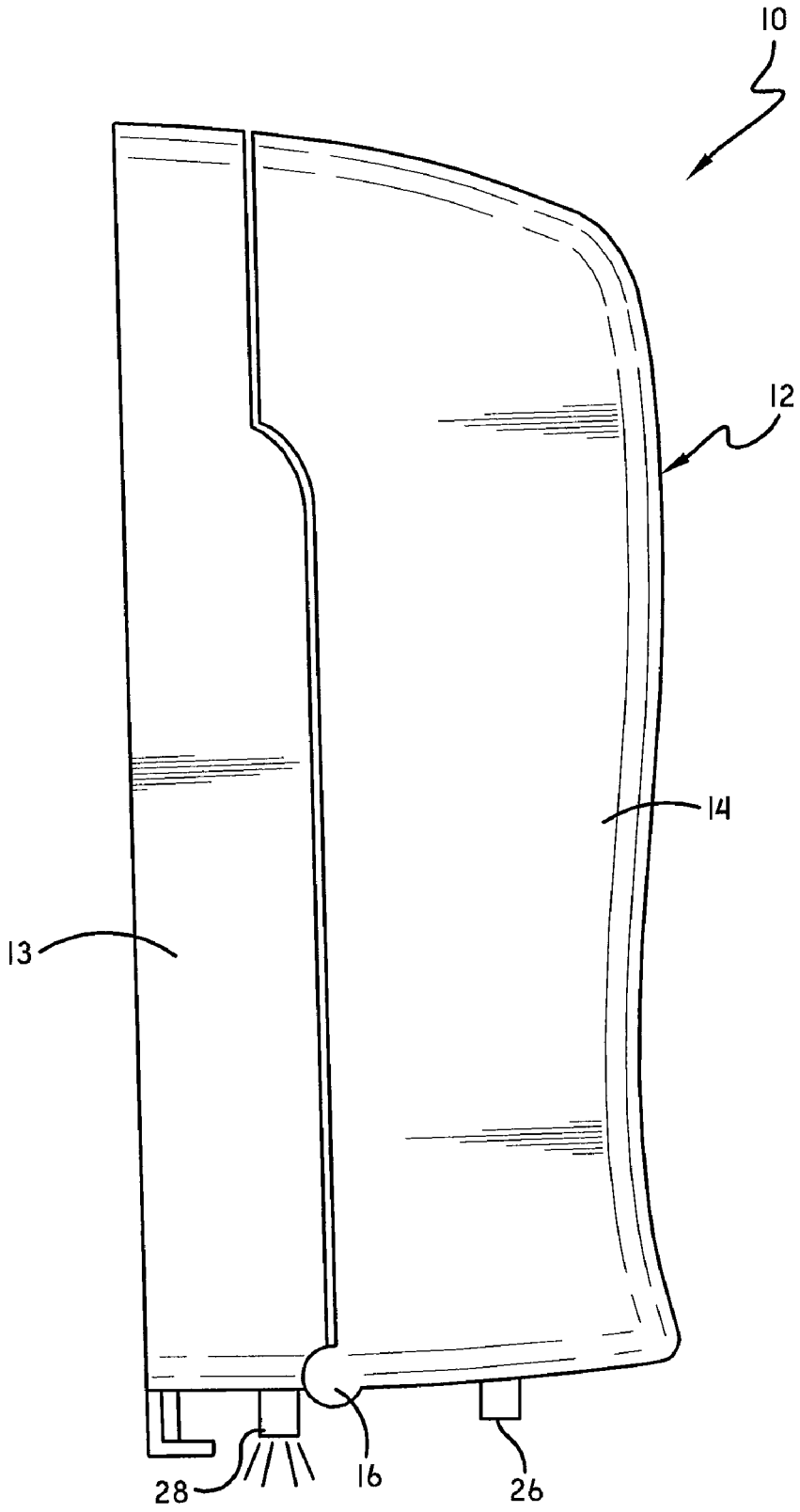
FIG.-1 PRIOR ART
FIG. 1 is a side view of the exterior of an exemplary dispenser of the prior art.
Figure 2:
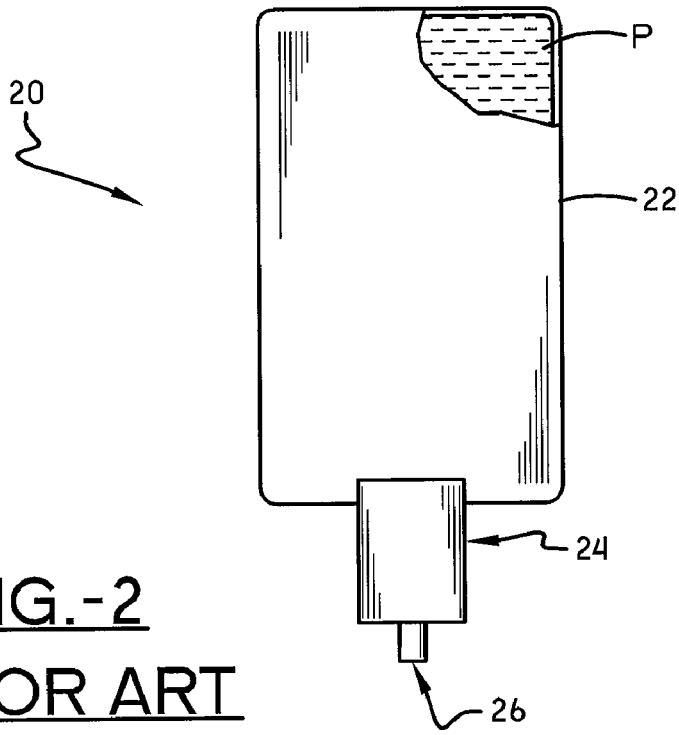
FIG.-2 PRIOR ART
FIG. 2 is a front view of an exemplary refill unit for use in the dispenser of FIG. 1.
Figure 3:
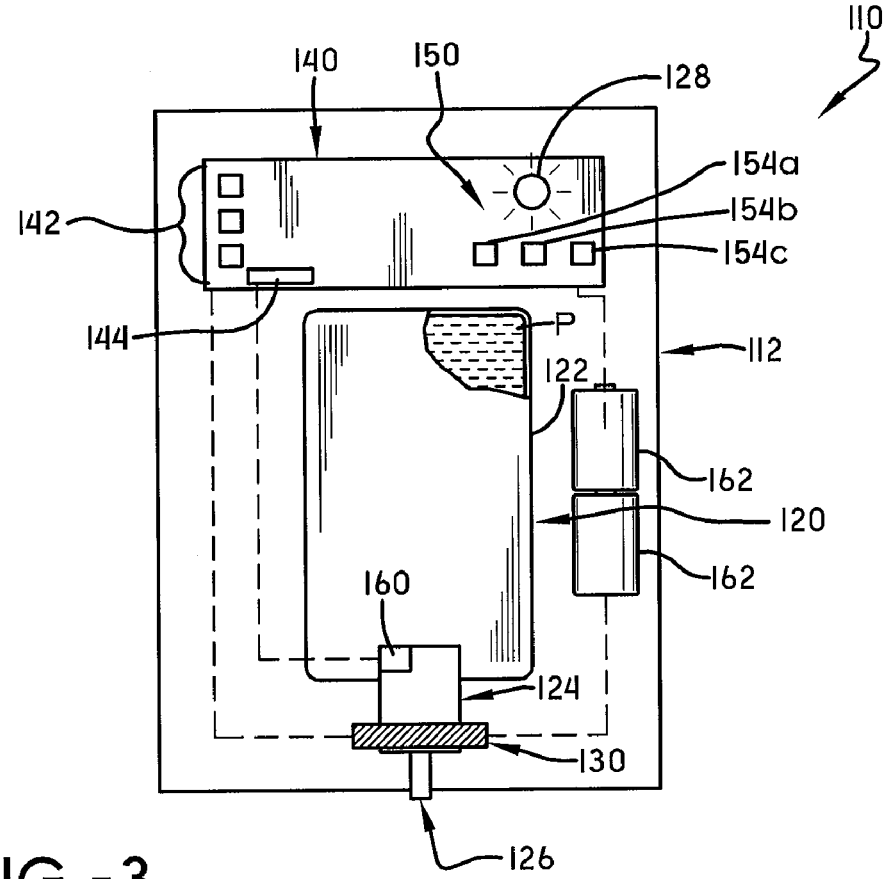
FIG. 3 is a schematic representation of a dispenser in accordance with this invention.

Referring now to FIG. 3, the dispenser of the present invention is schematically shown and represented by the numeral 110. The dispenser 110 is schematically shown with a housing 112, which can take the general form of the housing 12 of FIG. 1, though there is no particular limitation to be applied to the housing 112. The housing 112 is adapted to receive a refill unit 120, which includes a container 122 and a pump 124. The container 122 holds a volume of product P, and the pump 124 is secured to the container 122 to communicate with the interior thereof, such that, upon actuation of the pump 124, product P is advanced to the outlet 126 of the pump 124.

While a refill unit 120 has been specifically mentioned herein, it should be appreciated that the pump 124 need not be provided as part of such a refill unit, though that is generally one of the more popular practices in the art, particularly in the art of soap and sanitizer dispensers. As an alternative, the pump could be provided as a more permanent part of the housing, and could be adapted to communicate with replacement product containers.

The pump 124 is of a type having a discrete dispense cycle, as already defined herein. Thus, actuating the pump 124 entails manipulating it from an unactuated state to an actuated state, and causes a discrete dose of the product P to be dispensed at the outlet 126. Particular non-limiting examples of useful pumps include peristaltic pumps, dome pumps, and reciprocating piston pumps, all of which are well known. The pumps employed in accordance with this invention can be designed virtually identically to such known pumps except that they are specifically designed so that the discrete dose of product that they dispense upon cycling through one discrete dispense cycle is less than the dose of product that is necessary or desired by the user or the dispenser provider. That is, the pumps employed in this invention are specifically designed so that they must be manipulated through multiple discrete dispense cycles to yield a dose desired by the user or dispenser provider. Single component and multi-component pumps are acceptable. One example of a multi-component pump is a foam pump, wherein a foamable liquid, carried by a container, is mixed with air to form a foam product dispensed at the outlet of the pump.

As a particular example, the dose of soap delivered to one using a soap dispenser is typically from 0.5 to 2.0 milliliters (ml). This reflects the actual amount of liquid soap dispensed, and it will be appreciated that, when a foamed soap is dispensed, the foamed soap may be much more voluminous, having been expanded by air mixed with the liquid soap. In particular embodiments where a liquid soap is dispensed, the dose is usually from 1 to 1.5 ml, and, where a foamed soap is dispensed, the amount of liquid soap is usually from 0.7 to 1.1 ml, again, with the understanding that the actual foam product is more voluminous. These doses have been found to be suitable to provide a sufficient amount of soap for washing one's hands. These same general ranges apply to the dispensing of liquid sanitizers and foamed sanitizers, thought it will be appreciated that the lower limit for sanitizer is typically about 1.0 ml, in order to ensure that a sufficient amount of sanitizer is provided for killing germs etc. Thus, the pumps employed in prior art soap and sanitizer dispensers are designed so that one actuation (one discrete dispense cycle) dispenses a discrete dose of liquid soap or sanitizer of somewhere between 0.5 and 2.0 ml, more typically between 0.7 to 1.5 ml, and typically at least 1.0 ml when it is sanitizer that is being dispensed.

By way of example only, while discrete dispense cycle pumps of the prior art are specifically designed to dispense a desired 1.0 ml of soap, in accordance with the present invention, a discrete dispense cycle pump would be purposefully designed to dispense a dose of soap that was significantly less than the desired 1.0 ml, for example 0.1 ml. This pump would then be actuated 10 times to achieve the exemplary 1.0 ml desired dose of soap.

In accordance with one embodiment of this invention, continuing the foregoing example, the dispenser 110 is a soap dispenser, and the pump 124 is configured to provide a discrete dose of from 0.1 to 0.3 ml. With such a small discrete dose volume, the pump 124 of this particular embodiment is actuated multiple times to provide the desired dose to the end user. For example, with a pump having a discrete dose volume of 0.1 ml, the pump must be actuated 7 times to achieve a desired dose of 0.7 ml, or must be actuated 10 times to achieve a desired dose of 1.0 ml. The numerous actuations would occur in a time period short enough that the user of the dispenser does not inadvertently remove their hand from below the dispenser, incorrectly believing the dispense event is complete before the proper number of doses has been dispensed.

Despite the disclosure above respecting dose volumes, this invention is not limited to or by any particular discrete dose volume or dispensed volume. Additionally, thought soap and sanitizer are of particular concern to the inventors and their area of practice, it should be clear that the concepts herein are broadly applicable to the dispensing of various types of products.

The actuation of the pump 124 is controlled by an actuating mechanism 130 and a dispenser controller 140. The actuating mechanism 130 is retained by the housing 112 to interact with the pump 124. The actuating mechanism 130 includes physical structures that manipulate the pump 124 through its discrete dispense cycle and cause the pump 124 to dispense a discrete dose of the product P. For example, with a reciprocating piston pump as pump 124, the actuating mechanism 130 could include gears associated with an actuating carriage that engages the reciprocating piston such that, upon receiving a dispense request, the gears move the actuating carriage to reciprocate the piston and cause the dispensing of fluid. An example of this general concept is shown, by way of example only, in U.S. Published Pat. Applic. No. 2006/0124662, incorporated herein by reference. With a peristaltic pump as pump 124, the actuating mechanism 130 could include roller elements and appropriate drive mechanism therefore that contact the peristaltic pump tube to roll there against and cause the dispensing of a discrete dose of product. With a dome pump as pump 124, the actuating mechanism 130 could include gears that actuate a plunger to push the dome. An example of this general concept is shown, by way of example only, in U.S. Pat. No. 6,390,329, incorporated herein by reference. An eccentrically mounted plunger could also be employed to actuate any one of the forgoing types of pumps.

The actuating mechanism 130 is controlled by the dispenser controller 140, which can also be provided in the housing 112. Controller 140 includes appropriate hardware, software and memory to control the operation of the actuating mechanism 130 in accordance with the teaching herein. Particularly, the controller 140 is programmed to receive a dispense request, as generally represented at box 150 of the schematic of FIG. 3, and, upon such a request, acts upon the actuating mechanism 130 to cause it to actuate the pump a sufficient number of times to achieve the desired dose. The controller 140 preferably controls the actuating mechanism 130 such that the successive actuations of the pump 124 occur sufficiently quickly so that an end user will not withdraw their hand before all successive doses of product are dispensed. In some embodiments, all successive actuations occur within 1.5 second. In other embodiments, all successive actuations occur within 1 second. In other embodiments, all such successive actuations occur within less than 1 second. It is desired that each successive discrete dose follows the previous discrete dose such that the desired dose actually dispensed appears to be dispensed as one discrete volume. In some embodiments, each discrete dose is dispensed within 0.2 seconds of the previous discrete dose. In other embodiments, each discrete dose is dispensed within 0.1 seconds of the previous discrete dose.

The dispense request represented at 150 is simply the act of an individual appropriately interacting with the dispenser 110 to cause the dispenser to dispense product. In a particular embodiment, the dispense request 150 can be made by an individual activating a touchless sensor 128 that is positioned to sense the presence of a hand under the outlet 126. In another embodiment, the dispense request 150 can be made by an individual touching a particular dispense button 154*a*, 154*b* or 154*c*, as will be described more particularly below. It will be appreciated that the components (hardware, software) necessary for receiving a dispense request are part of the dispenser controller 140.

The benefits realized from this dispenser 110 are many. First, the dispenser 110 can be made to dispense virtually any desired dose of product without having to create different pumps for different applications. For example, where it was previously necessary to design a pump with a discrete dose of 1 ml for applications where a 1 ml dose is desired (the desired dose), and to design a pump with a discrete dose of 2 ml for applications where a 2 ml dose is desired, the dispenser 110 of this invention can be selectively programmed to dispense 1 ml or 2 ml or, indeed, any dose volume that is an increment of the discrete dose provided by one actuation of the pump 124. If the pump 124 is designed to dispense a discrete dose of 0.1 ml, programming the controller 140 to actuate the pump 10 times upon receiving a dispense request will yield a 1 ml desired dose, and programming the controller 140 to actuate the pump 20 times upon receiving a dispense request will yield a 2 ml desired dose. Thus, the dispenser manufacturers can make a single dispenser with a single pump, and simply change the programming for a given end user and that end user's desire dose for different types of products, different end uses, or different types of dispensers.

Second, the dispenser 110 can be programmed in a number of ways. The controller 140 can be preprogrammed by the manufacturer to yield a particular desired dose upon a dispense request. Alternatively, the controller 140 could include buttons or dials or other means generally indicated at 142 for programming the controller 140 to control the actuating mechanism 130 appropriately to achieve a desired dose. These buttons or dials 142 could be made accessible at the interior of the housing 112, to be accessed and employed by maintenance staff, or could be made accessible at the exterior of the dispenser housing, to be employed by each user, as desired. As yet another alternative, the controller 140 could be preprogrammed to control the actuator mechanism 130 in accordance with a volume selection made by the end user or service personnel. Particularly, the controller 140 could be programmed to receive a dispense request from the previously mentioned dispenser buttons 154*a*, 154*b*, 154*c*, with each button bearing indicia correlating to a different desired dose of product. By presenting these dispenser buttons 154*a*, 154*b*, 154*c* at the exterior of the dispenser 110, the end user could select a desired dose simply by pressing a given button, and the controller 140 would be programmed to control the actuating mechanism 130 accordingly to dispense the desired dose selected by the user. In a particular embodiment, the dispenser 110 dispenses soap and includes a 1 ml button, a 2 ml button and a 3 ml button selectable by the user in accordance with a desired dose the user wishes to receive. Those with heavily soiled or larger sized hands may opt for the larger dose (as might those individuals needing extreme cleanliness and sanitation, for instance in the use of a surgical scrub), while those with less soiled or smaller sized hands may opt for the smaller doses.

As yet another alternative for programming the dispenser 110, the controller 140 of the dispenser 110 could be preprogrammed to control the operation of the actuating mechanism 130 in accordance with a signal received from a refill unit 120. The controller would include a signal-receiving device 144 and be programmed to receive a signal from a signal-emitting device 160 carried by the refill unit 120. The controller 140 would be preprogrammed to recognize various signals, with each signal being associated with a particular desired dose. This will be particularly useful where the type of product being loaded into the dispenser via the refill unit 120 might change. By employing this programming concept, the amount of product dispensed will be a direct result of the signal generated by the signal-emitting device 160 and the programming of the controller 140. For example, if a mechanic's soap refill unit is inserted into the dispenser housing, the signal might cause the controller 140 to control the actuating mechanism so that a relatively large 2 ml dose of the mechanic's soap product is dispensed upon receiving a dispense request, while, if a sanitizer refill unit is inserted into the dispenser housing, the signal might cause the controller 140 to control the actuating mechanism so that a smaller 1.0 ml dose of the sanitizer product is dispensed.

It will be appreciated that dispensers of this type can be powered by a mains power supply (e.g., alternating current) or by battery or, indeed, by any suitable power (e.g. solar). The power supply, which in this embodiment is provided by batteries 162 preferably provides all necessary power to operate the actuating mechanism 130 and the controller 140, including any means chosen for making a dispense request as, for example, at 150 (e.g., touchless sensor 128 or buttons 154*a-c*), and any means chosen for changing the dose as, for example, at buttons 142 or at signal-receiving device 144. The signal-emitting device 160 can be either passive, in which case the power to emit the signal is provided from an outside source, or active, in which case the refill unit would carry an appropriate power source to provide the power to emit the signal. In one embodiment of a passive system, the signal receiving device 144 would emit power that would be absorbed by the signal-emitting device 160, when in close proximity, and, thus, when mounted to the dispenser housing, the signal emitting device 160 could emit the signal to be received by the signal-receiving device. Multiple power sources could be employed as well, with separate power sources powering separate components.

Here, the batteries 162 are shown associated with the controller 140 and the actuator mechanism 130. The actuator mechanism 130 requires the majority of the batteries' power. Aside from providing a more universal dispenser capable of dispensing different desired doses of product in accordance with the programming of a controller, this invention provides a dispenser that more efficiently uses batteries.

Figure 4:
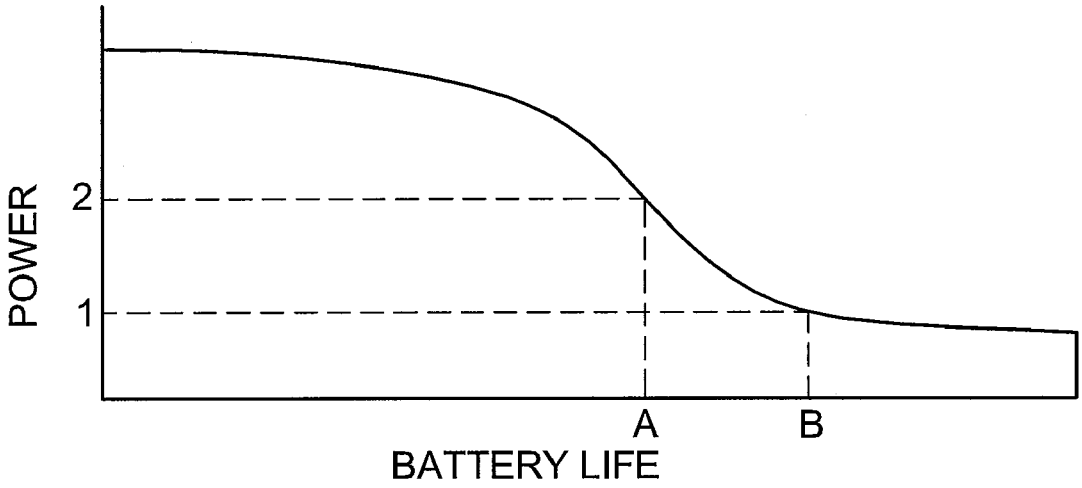
FIG. 4 is a graph generally representing the power of a battery as plotted against the life of the battery.

As seen in FIG. 4, the power supplied by a battery or collection of batteries (typically more than one battery is employed to power a dispenser) decreases over the course of the battery's life as the battery is used. Because the present invention employs a pump having a discrete dose that is purposefully chosen to be less than the desired dose, the useful life of the battery array is extended as compared to using the same battery array for a pump having a discrete volume that is identical to the desired volume. By way of example, and with reference to the graph of FIG. 4, if the desired dose volume is 1 ml, and a pump having a discrete dose of 1 ml is employed, a power level of 2 might be necessary to actuate the pump, and the battery would only be useful up to point A in the timeline representing the battery life. However, if the pump is purposefully designed to be smaller and has a discrete dose of 0.1 ml, it might be necessary to actuate that pump 10 times to obtain the 1 ml desired dose, but a lesser power level (shown at 1 on the graph of FIG. 4) would be suitable to actuate the pump, and the battery would therefore be useful up to point B in the timeline representing the battery life.

Figure 5:
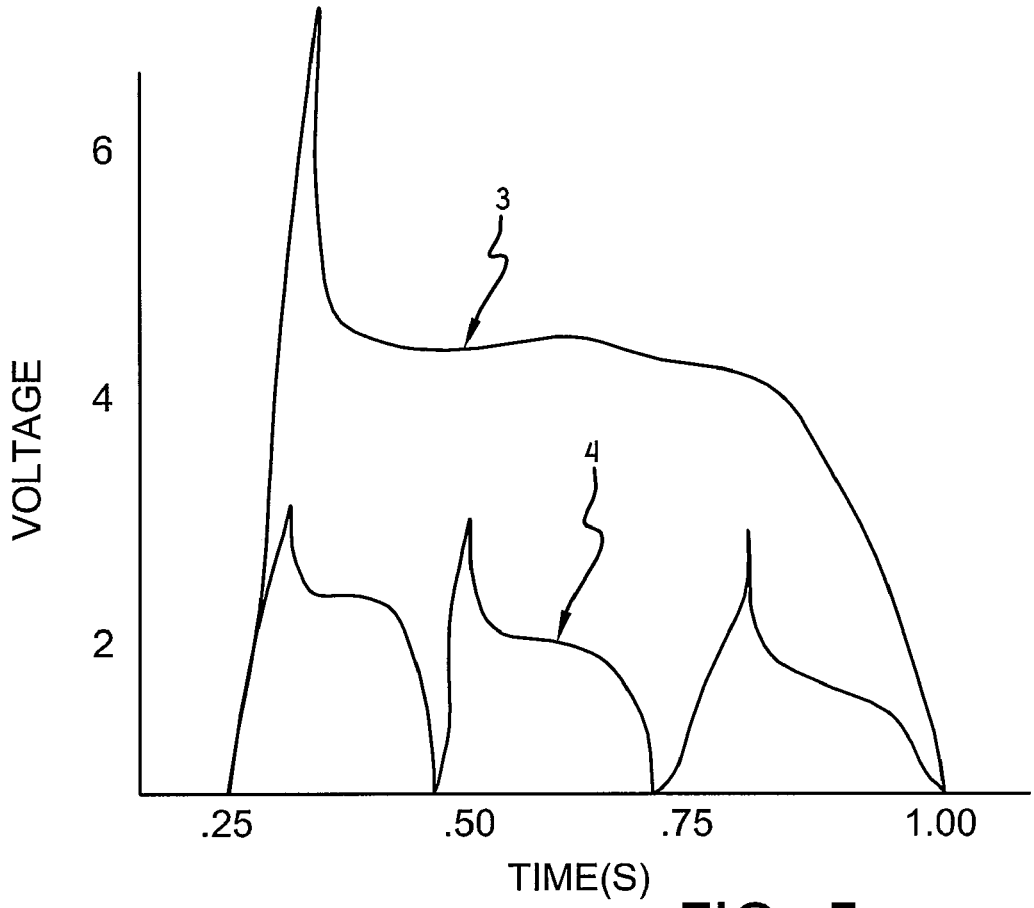
FIG. 5 is an exemplary graph showing both the voltage drawn by a single actuation of a larger pump providing a desired dose and the voltage drawn by multiple (3) actuations of a smaller pump to provide the same desired dose.

This advantage is also graphically displayed in FIG. 5, wherein voltage is graphed against time. A first voltage curve 3 shows an example of the voltage drawn by actuation of a pump that delivers a desired dose in a single actuation taking approximately 0.75 seconds. A second voltage curve 4 shows an example of the voltage drawn by three successive actuations of a pump that delivers ⅓ of the desired dose upon a single actuation, with all three actuations occurring in 0.75 seconds as well. Each pump represented in the graph of FIG. 5 delivers the same end volume, but a much lower initial voltage is required for the smaller pump that is actuated multiple times. Neither of the pumps represented in the graph of FIG. 5 can be used if the battery or other power supply supplies a voltage below the peak of each curve. Because the peak for the smaller pump is much lower than that for the larger pump, when battery power is employed, the batteries will have a longer useful life when the smaller pump is employed.

Yet a further benefit of the pump of this invention is a decrease in the physical size of the pump. Since the pump is designed to dispense doses of product that are smaller than the desired dose, the physical size of the pump will be reduced as compared to a pump designed to dispense a discrete dose that is equal to the desired dose. This reduced physical size of the pump occupies less space within the dispenser housing in which it is placed. The size of the dispenser can then be reduced if desired, or alternatively, the extra space within the dispenser can be used for other purposes, such as increasing the amount of product within the dispenser or using the space for other purposes.

The pumps employed in accordance with this invention may be virtually any pump that dispenses a discrete dose of product through a discrete dispense cycle. These include liquid pumps and foam pumps, which combine air and liquid and dispense a discrete dose of foam.

In light of the foregoing, it should be appreciated that the present invention significantly advances the dispensing arts by providing a dispenser that is structurally and functionally improved in a number of ways. While particular embodiments of the invention have been disclosed in detail herein, it should be appreciated that the invention is not limited to or by any particular structure or function. Variations on the invention herein will be readily appreciated by those of ordinary skill in the art, and the scope of the invention shall be appreciated from the claims that follow.

What is claimed is:

1. A dispenser comprising:

a pump that, upon actuation, progresses through a discrete dispense cycle to dispense a discrete dose of product, said discrete dose being less than a desired dose of product;

an actuating mechanism to actuate said pump;

a dispenser controller controlling operation of said actuating mechanism, wherein, when said dispenser controller receives a single dispense request, said dispenser controller causes said actuating mechanism to actuate said pump multiple times to dispense said discrete dose multiple times to achieve a dispensing of said desired dose.

2. The dispenser of claim 1, wherein said dispenser controller includes a touchless sensor that senses the presence of a hand at a dispensing location provided by the dispenser, the sensing of the presence of the hand serving as said dispense request.

3. The dispenser of claim 2, wherein said dispenser controller includes a button on an exterior of the dispenser, the pressing of said button serving as said dispense request.

4. The dispenser of claim 1, wherein said pump is selected from the group consisting of reciprocating piston pumps, dome pumps and peristaltic pumps.

5. The dispenser of claim 4, wherein said pump is a reciprocating piston pump.

6. The dispenser of claim 5, wherein said reciprocating piston pump is a foam pump.

7. The dispenser of claim 4, wherein said reciprocating piston pump has a discrete dose volume of from 0.1 to 0.3 ml.

8. The dispenser of claim 7, wherein said dispenser controller causes said actuating mechanism to actuate said reciprocating piston pump from 2 to 30 times.

9. The dispenser of claim 8, wherein said discrete dose volume is 0.1 ml, and said dispenser controller causes said actuating mechanism to actuate said reciprocating piston pump at least 7 times.

10. The dispenser of claim 1, wherein the actuation of said pump multiple times by said actuating mechanism occurs within 1.5 seconds.

11. The dispenser of claim 1, wherein said desired dispensing dose volume is preprogrammed into the dispenser.

12. The dispenser of claim 1, wherein said desired dispensing dose volume is selectable at the dispenser by either an individual using the dispenser or by service personnel.

13. The dispenser of claim 1, wherein said dispenser includes a dispenser housing that selectively receives a refill unit, said refill unit carrying a volume of product to be dispensed by the dispenser, and said refill unit carrying said pump.

14. The dispenser of claim 1, wherein said dispenser is battery operated.

15. A dispenser comprising:

a pump designed to have a discrete dispense cycle through which the pump progresses to dispense a single discrete dose of product, said discrete dose being less than a desired dose of product; and a controller designed to actuate said pump, wherein, when said controller receives a single dispense request, said controller causes said pump to progress through said discrete dispense cycle at least two times to dispense said discrete dose at least two times to achieve a dispensing of said desired dose.

16. A product refill unit comprising:

a container containing a volume of product, wherein said container is sized to fit within a dispensing unit; and a pump, wherein said pump is configured to receive product from said container, and further wherein said pump is designed to operate such that it has an actuated state and an unactuated state, wherein a discrete dose of said product is dispensed from said pump during said actuated state, and yet further wherein said pump is controlled by a controller such that said pump is actuated at least two times in succession to dispense a desired volume of said product wherein said discrete dose of said product is less than said desired volume of said product.

* * * * *